United States Patent [19]

Erk

[11] Patent Number: 4,857,017

[45] Date of Patent: Aug. 15, 1989

[54] SUPPORT DEVICE FOR WIRES IN MULTI-CONTACT CONNECTORS

[75] Inventor: Kaya Erk, San Jose, Calif.

[73] Assignee: Maxconn, Inc., San Jose, Calif.

[21] Appl. No.: 252,008

[22] Filed: Sep. 27, 1988

Related U.S. Application Data

[63] Continuation of Ser. No. 42,385, Apr. 24, 1987, abandoned.

[51] Int. Cl.[4] ..... H01R 13/502

[52] U.S. Cl. ..... 439/695; 439/78; 439/701

[58] Field of Search ..... 439/78, 82, 629, 701, 439/695, 696, 634, 686, 688, 689, 752

[56] References Cited

U.S. PATENT DOCUMENTS

| | | | |
|---|---|---|---|
| 3,601,762 | 8/1971 | Eshelman | 339/64 M |
| 3,905,673 | 9/1975 | Evans et al. | 439/629 |
| 4,050,769 | 9/1977 | Ammon | 339/196 M |
| 4,080,041 | 3/1978 | Hawkins, Jr. | 339/196 M |
| 4,469,387 | 9/1984 | McHugh | 339/42 |
| 4,565,416 | 1/1986 | Rudy et al. | 339/59 M |
| 4,568,136 | 2/1986 | Reuss | 439/629 |
| 4,618,207 | 10/1986 | Silbernagel | 439/701 |
| 4,699,595 | 10/1987 | Nakazawa et al. | 439/701 |

FOREIGN PATENT DOCUMENTS

| | | | |
|---|---|---|---|
| 2348610 | 4/1975 | Fed. Rep. of Germany | 439/752 |

*Primary Examiner*—David Pirlot
*Attorney, Agent, or Firm*—Thomas Schneck

[57] ABSTRACT

A right-angle connector having an array of angulate contact elements supported by a locking support member in frictional engagement with said connector. The array of angulate contact elements consists of at least two rows varying in extension and height. The locking support member is received into the open-ended rear surface of the connector and indents within the member are disposed to individually receive a contact element. The indents are volumetrically staggered to coincide with the array of contact elements.

8 Claims, 2 Drawing Sheets

SUPPORT DEVICE FOR WIRES IN MULTI-CONTACT CONNECTORS

This is a continuation of co-pending application Ser. No. 042,385 filed on Apr. 24, 1987 now abandoned.

DESCRIPTION

1. Technical Field

The invention relates generally to electrical connectors and particularly to wire supports for electrical connectors having angulate contact elements.

2. Background Art

Mating connectors for electrically coupling components of an electrical assembly are well known. Connectors are employed, for example, to couple printed circuit boards within an instrument or to couple various instruments. Typically, electrical connectors include a body member which houses a plurality of contacts, with one end of each contact permanently attached to a component or, in those cases in which the connector is a part of a cable, to a wire. The ends of the contacts opposite this permanent attachment are either male or female in gender so that the connector may be mated to a complementary connector having contacts of the opposite gender.

Electrical connectors designed for permanent attachment to a printed circuit board normally utilize angulate contacts, which are typically orthogonal, or right-angle, contacts. Such contacts each have a portion that extends outwardly from the connector body for perpendicular connection to the circuit board and have a portion that extends from the connector body parallel the circuit board for connection with a contact of an opposite gender.

When brought into a mating relationship, the male contact pins and female contact sockets of connectors experience tension which may cause bending of the male pins. Moreover, the portion of the contact that is within the interior of the connector body may be damaged. In a right-angle contact, the elbowed segment of the contact is susceptible to damage.

In addition to potential contact bending during mating of a female to a male connector, contacts in a right-angle connector are susceptible to damage during insertion of the contacts into plated holes of a printed circuit board. U.S. Pat. No. 4,469,387 to McHugh teaches a contact locating member that is slidably mounted to the contacts to maintain the spatial relationship between contacts during insertion into a circuit board. The contact locating member, however, is not designed to provide support during mating of conectors. U.S. Pat. No. 4,080,041 illustrates another contact locating member.

Often, the rear surface of a right-angle connector is open-ended. While such a construction facilitates repairability, the open-ended surface provides no support to the contacts of the connector. Thus, the connectors are particularly liable to bend during insertion of contacts into a board or during mating of connectors. Moreover, loose conductive particles may short contacts together if the particles are inadvertantly dropped into the body of the connector. U.S. Pat. No. 4,050,769 to Ammon discloses an electrical connector which employs a plurality of removable members which allow repair of individual contacts and also support the contacts. The Ammon connector, however, is an assemblage of parts that is pieced together to create the connector. None of the pieces may be used on connectors of other manufacturers. The same is true of U.S. Pat. No. 3,601,762 to Eshelman.

An object of the present invention is to provide a support to angulate contacts so as to reduce the possibility of contact damage during insertion of the contacts into a printed circuit board or into a complementary connector of the opposite gender.

DISCLOSURE OF THE INVENTION

The above object has been met by a locking support member which is made of a dielectric material and which may be slidably coupled to a connector to provide support to the connector contact elements, i.e. wires, or may be detached from the connector to facilitate connector repair. The locking support member may be a retrofit for pre-existing connectors.

The locking support member is substantially rectangular and is slidably fit into the open-ended back surface of a connector having at least two rows of angulate contact elements arranged in those rows in an alternating fashion relative to each other. Typically, the contact elements are orthogonal contact elements in a right-angle connector. The locking support member includes a plurality of teeth defining indentations, each indentation receiving a single contact element. To provide support to a contact element both during insertion into a circuit board and during insertion into a contact element of an opposite gender, the dimensions of the cover portions and the rearward walls of indentations are staggered relative to a printed circuit board and to the connector mating surface, respectively.

The indentations are thus dimensioned to closely receive a contact element so as to securely hold the contact element into the connector, thereby reducing the risk of contact element bending and lessening the chance of a contact element being pushed from the connector body.

The connector itself includes a connector body which may be secured to a printed circuit board prior to the application of solder to the contact elements by spreader tines which are urged apart to apply a force to the circumference of a receiving hole in a circuit board. The locking support member is frictionally fit into the open back of the connector to provide support and to prevent inadvertent shorting between contact elements. To facilitate insertion of the locking support member into the connector, the front portion of the locking support member's side edges are angled inwardly, relative to the axis of the connector body.

BEST MODE FOR CARRYING OUT THE INVENTION

Figure 1:
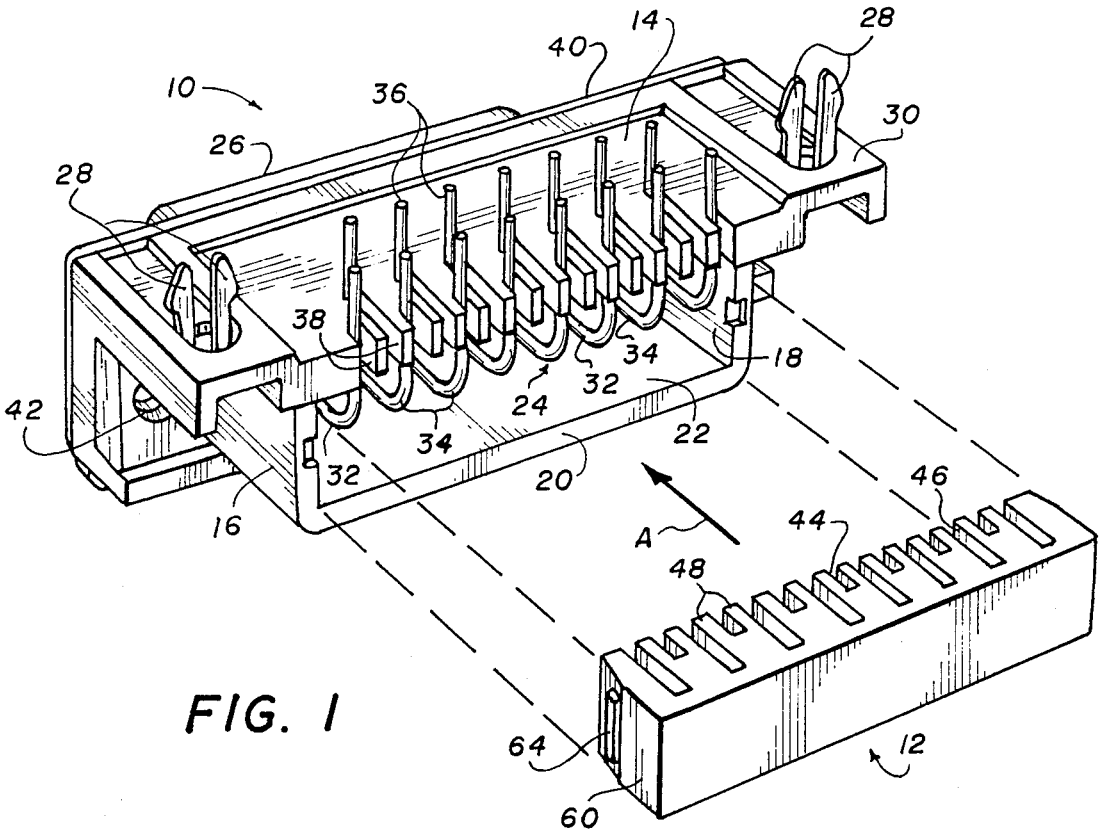
FIG. 1 is a perspective view of a connector in accord with the present invention.
Figure 2:
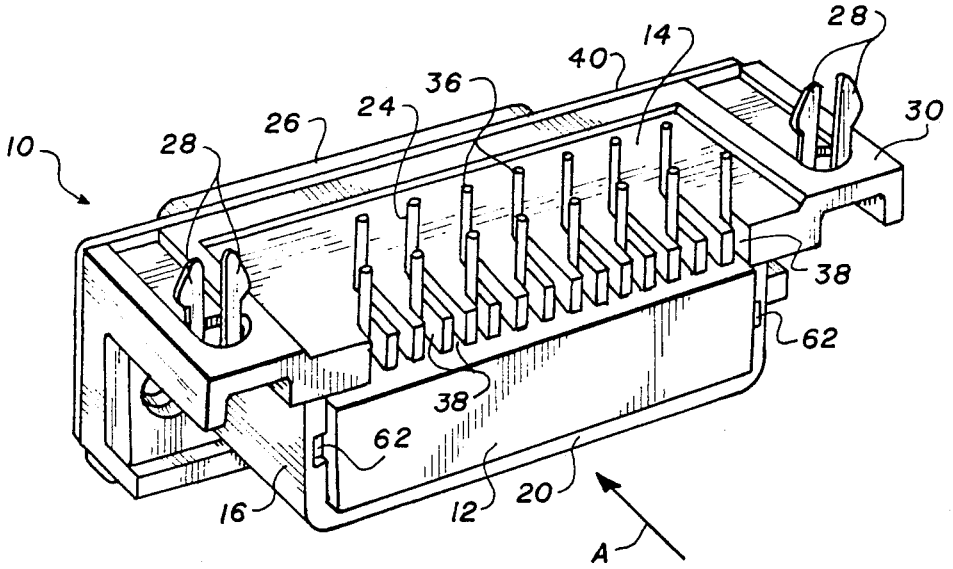
FIG. 2 is a perspective view of the connector of FIG. 1 after insertion of the locking support member.

With reference to FIGS. 1 and 2, the present invention comprises a multiple contact connector 10 and a dielectric locking support member 12. The multiple contact connector 10 includes a circuit board coupling surface 14, opposed lateral housing surfaces 16 and 18 and a cover surface 20. The surfaces 14–20 define a housing opening 22.

The connector 10 is a right-angle connector having a plurality of angulate contact elements 24 press fit into a mating surface 26 of the connector. The connector shown in FIGS. 1 and 2 is a miniature connector and is of the kind commonly referred to as Type D. This, however, is not critical. The connector is shown to have 15 orthogonal contact elements 24, but again this is not critical.

Spreader tines 28 extend from the connector 10 perpendicular to the circuit board coupling surface 14. The spreader tines 28 are positioned to be received by apertures in a printed circuit board, not shown. The spreader tines are urged apart and will secure the connector 10 to a circuit board while the contact elements are soldered to the circuit board. The circuit board coupling surface has a stepped portion 30 to stand the surface 14 away from the surface of a circuit board, thereby permitting enhanced solder flow between the connector 10 and the circuit board.

The contact elements 24 each have a first rectilinear segment 32, an angulate segment 34 and a second rectilinear segment 36. The second rectilinear segments are received by slots 38 in the surface 14. The contact elements 24 of a right-angle connector are typically arranged in at least two rows with the contact elements disposed in the rows in an alternating fashion relative to a plane extending parallel the contact elements. This staggered arrangement occurs at both the first and the second rectilinear segments. The slots 38 which are utilized to facilitate alignment of the contact elements with plated holes in a circuit board are accordingly staggered in length.

The first rectilinear segments 32 of the contact elements are press fit into the mating surface 26 of the connector. The contact elements may be either male pins or female sockets. Likewise, the mating surface may be part of the mating face 40 of either a male or a female type connector. The face 40 of the connector and the tips of the first rectilinear segments 32 are adapted for engagement with a connector or a contact element of the opposite gender. Holes 42 on opposed sides of the mating surface 26 are disposed to receive fastening bolts, not shown, for fastening the connector 10 to a panel of an instrument and/or to a connector of the opposite gender.

The housing surfaces 14–20 of the connector 10 are constructed of a dielectric material. The mating face 40 is made of a sturdy material such as steel and is plated with zinc or tin. The contact elements of a D type connector are typically brass with gold flash over an undercoating of nickel.

By itself, the connector 10 provides relatively little support to the contact elements 24. Depending upon how tightly the contact elements are held at the mating surface 26, a certain amount of play exists at the tip of the first rectilinear segment. The play is greatest when the contact elements are secured to the connector by means of wings which are biased outwardly from the circumference of the contact elements so that the tips of the contact elements cannot reenter a bore after the wings have been released. Any play is detrimental since movement will permit misalignment of a male pin with a female socket during connector engagement. Such misalignment may result in the bending of contact elements, especially free-standing pins. Additionally, bending of contact elements may occur as a result of the force placed upon the contact element during insertion into a printed circuit board.

Referring now to FIGS. 1 and 3–7, the present invention includes a locking support member 12 having indentations 44 and 46 which receive contact elements when the support member is fitted into the multiple contact connector 10, as shown by Arrow A. Teeth 48 in the support member 12 define minor indentations 44 and major indentations 46. The indentations 44 and 46 are further defined by rearward walls 50 and 52 and cover walls 54 and 56.

The indentations 44 and 46 are volumetrically staggered so as to enhance the support of the orthogonal contact elements 24. Such volumetric staggering allows each indentation 44 and 46 to house, in at least a closely adjacent manner, the contact elements which vary in extension relative to the mating surface 26 of the connector 10. Preferably, each indentation houses a portion of the second rectilinear segment 36 and at least a portion of the angulate segment 34 of a contact element and the teeth 48 contact opposed sides of the contact elements. Such an arrangement provides the support necessary to guard against misalignment of contact elements during mating of the connector 10 to a complementary connector or to a printed circuit board. Moreover, the indentations will hold the contact elements securely in position to reduce the risk of pushing the contact elements from the mating surface 26 during connector engagement.

Figure 3:
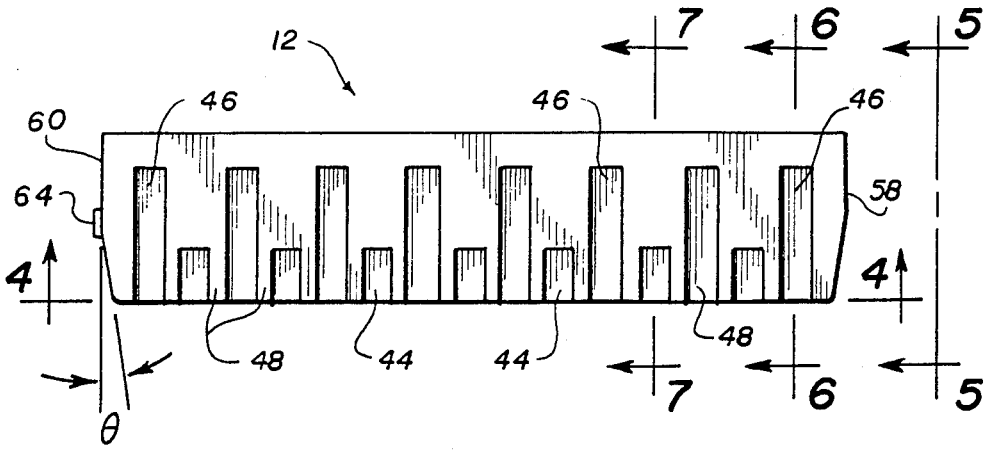
FIG. 3 is a top view of the locking support member of FIG. 1.
Figure 4:
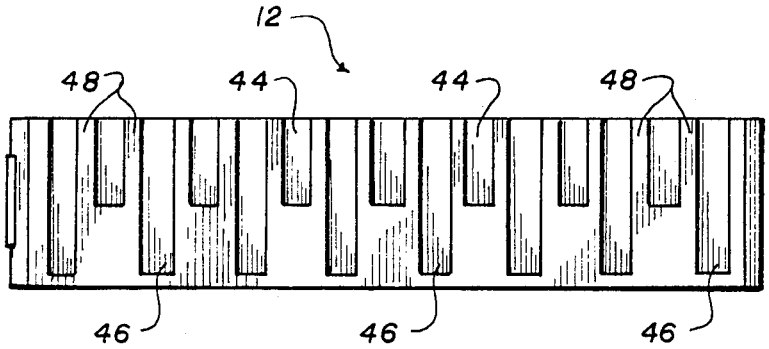
FIG. 4 is a front view of the locking support member of FIG. 3 taken along lines 4—4.
Figures 5, 6, 7:
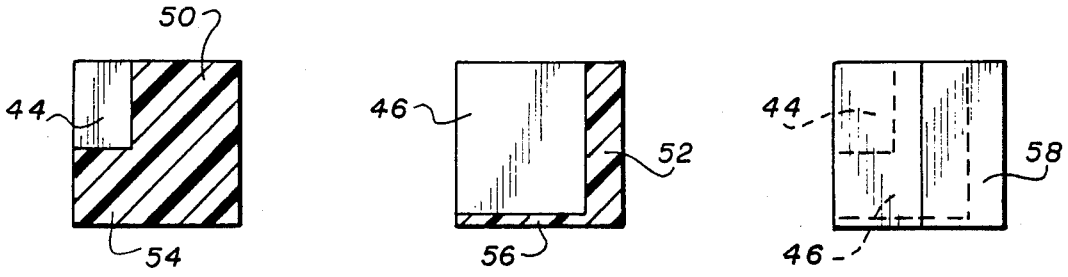
FIG. 5 is a side view of the locking support member of FIG. 3 taken along lines 5—5.
FIG. 6 is a side section view of the locking support member of FIG. 3 taken along lines 6—6.
FIG. 7 is a side section view of the locking support member of FIG. 3 taken along line 7—7.

Referring now to FIGS. 2 and 3, in operation the locking support member 12 is inserted into the connector 10 for frictional engagement therewith. The indents 44 and 46 are staggered both in height and depth to properly engage an associated contact element. Since the support member 12 is snugly received by the connector 10, the lateral edges 58 and 60 of the support member are partially beveled to facilitate initial alignment of the support member. The angle $\theta$ of the beveled lateral edges is not critical but the beveling should not intersect an indentation 44 and 46. The support member 12 is inserted into the housing opening 22 until the support member is flush with the rear surface of the connector.

The locking support member 12 provides support to the contact elements but, at the same time, permits repair of individual contact elements. After insertion the support member 12 may be removed from the connector 10 by application of a rearward force on the support member at one or both of two notches 62 in the surfaces 16 and 18 of the connector. A raised tab 64 on the lateral edge 60 of the support member facilitates removal.

While the drawings illustrate the contact elements 24 to be orthogonal contact elements, it is to be understood that the elbowed contact elements need not be angled at 90°. Likewise, the locking support member 12 of the present invention may be used with connectors other than right-angle type D connectors.

I claim:

1. A multiple contact connector comprising, a connector body having a body interior and having a front mating surface and an open-end body cavity, a plurality of angulate contact elements, each contact element having a first and second rectilinear segment and an angulate segment coupling said rectilinear segments, said first rectilinear segments fixed to the front mating surface in an array of at least two rows, said second rectilinear segments arranged at an angle to the first segments in at least two rows in an alternating fashion relative to a plane extending parallel to said second rectilinear segments through a base coupling surface, and a locking reinforcement support member having a mating means for selectively engaging said connector body at said open-end body cavity, said locking support member having a plurality of teeth spaced apart to define indentations, said indentations each being partially defined by rearward walls, said rearward walls having a staggered distance relative to said front mating surface when said locking support member engages said connector body, each indentation correspondingly housing and supporting a portion of a second rectilinear segment and a portion of an angulate segment of a contact element when said locking support member is brought into mating engagement with said connector body, said indentations each partially defined by a cover portion, said cover portions staggered in distance relative to a plane parallel to said first rectilinear segments so as to coincide with said array of the first rectilinear segments.

2. The multiple contact connector of claim 1 wherein said interior of the connector body is defined by housing walls having a substantially rectangular shape, said locking support member being slidably received into the interior of the connector body by said open-end of said body cavity.

3. The multiple contact connector of claim 1 wherein said lock support member is a dielectric material.

4. The multiple contact connector of claim 2 wherein said locking support member has a substantially rectangular cross section and has opposed lateral edges having beveled portions for insertion into said open-ended rear surface of said connector body.

5. The multiple contact connector of claim 2 wherein said locking support member is in frictional engagement with said connector body.

6. A support device for portions of angulate contact elements within an interior of a multiple contact connector having a front mating surface, opposed lateral surfaces, a cover surface, a base surface and an open-end body cavity, said multiple contact connector further having means for unaidedly securing said angulate contact elements, said angulate contact elements secured for attachment to a first external article at said front mating surface and to a second external article at said base surface, said support device comprising, a locking reinforcement support member slidably fit within said open end of said body cavity defined in said multiple contact connector, said open end of the body cavity having a configuration to selectively receive said locking support member while preserving the integrity of said connector body after attachment of said angulate contact elements to said second external article, said locking support member having a plurality of parallel teeth, said teeth spaced apart to define a plurality of indentations having a spatial arrangement to individually receive an angulate contact element disposed in an array of at least two rows of said contact elements coupled to said front mating surface of said multiple contact connector, said indentations being perpendicular to said front mating surface and being parallel to and alternate in length relative to said opposed lateral surfaces, said indentations alternating in height relative to a plane extending perpendicular to said front mating surface.

7. The support device of claim 6 wherein said locking support member is in frictional engagement with said multiple contact connector.

8. The support device of claim 6 wherein said locking support member is a dielectric material.

* * * * *